US011974680B1

(12) United States Patent
Davis

(10) Patent No.: US 11,974,680 B1
(45) Date of Patent: May 7, 2024

(54) PICTURE HANGING APPARATUSES AND METHODS OF USE

(71) Applicant: Todd Leslie Davis, Bixby, OK (US)

(72) Inventor: Todd Leslie Davis, Bixby, OK (US)

( * ) Notice: Subject to any disclaimer, the term of this patent is extended or adjusted under 35 U.S.C. 154(b) by 0 days.

(21) Appl. No.: 17/840,080

(22) Filed: Jun. 14, 2022

(51) Int. Cl.
*A47G 1/16* (2006.01)
*A47G 1/06* (2006.01)

(52) U.S. Cl.
CPC ..... *A47G 1/1686* (2013.01); *A47G 1/065* (2013.01); *A47G 1/1606* (2013.01)

(58) Field of Classification Search
CPC ..... A47G 1/1686; A47G 1/1606; A47G 1/065
See application file for complete search history.

(56) References Cited

U.S. PATENT DOCUMENTS 4,043,477 A * 8/1977 Deese ..... G09F 5/00 206/83
4,912,863 A * 4/1990 Harvey ..... A47G 1/065 40/781
5,588,240 A * 12/1996 Zilliox ..... G09F 1/12 40/605
6,742,295 B2 6/2004 Gross
7,437,846 B2 10/2008 Franco et al.
7,841,115 B2 11/2010 Saunders-Singer
8,333,026 B2 * 12/2012 Southard ..... A47G 1/16 40/745
8,572,873 B2 11/2013 Van Bortel
9,408,482 B2 8/2016 Nesbitt
9,687,091 B2 * 6/2017 Jhagroo ..... A47G 1/065
10,064,504 B2 * 9/2018 Hogrefe ..... A47G 1/065
10,786,098 B1 * 9/2020 Martin ..... A47G 1/065
11,033,124 B1 * 6/2021 Stark ..... A47G 1/1606
11,141,006 B2 * 10/2021 Fitzpatrick ..... A47G 1/166
11,369,218 B2 * 6/2022 Gutschke ..... A47G 1/04
2003/0056413 A1 3/2003 Wiemer et al.
2007/0234621 A1 * 10/2007 McCorkle ..... A47G 1/065 40/773
2013/0344467 A1 * 12/2013 Norcross ..... G06Q 10/06398 428/80
2014/0237875 A1 * 8/2014 Randall ..... A47G 1/065 40/797
2021/0204724 A1 7/2021 Phillips et al.

* cited by examiner

*Primary Examiner* — Ko H Chan
(74) *Attorney, Agent, or Firm* — Lexigent LLC

(57) ABSTRACT

Picture hanging apparatuses and methods of use are disclosed herein. An example system can include a first frame having a plurality of struts arranged into a polygon, at least one of the plurality of struts comprises a receiver slot, the first frame being configured to be secured to a wall and receive a first picture; a second frame that is identical to the first frame, the second frame receiving a second picture; and a coupling member spacing the first frame with the first picture from the second frame with the second picture.

15 Claims, 12 Drawing Sheets

PICTURE HANGING APPARATUSES AND METHODS OF USE

CROSS-REFERENCE TO RELATED APPLICATION(S)

N/A.

TECHNICAL FIELD

The present disclosure pertains to picture hanging apparatuses and methods of use.

SUMMARY

According to some embodiments, the present disclosure is directed to a device comprising: a frame comprising a first strut, a second strut, a third strut, and a fourth strut, wherein at least one of the first strut, the second strut, the third strut, and the fourth strut comprise a receiver slot, the frame being configured to be secured to a wall and receive a picture; and a coupling member comprising a first key disposed on a first end of the coupling member and a second key disposed on a second end of the coupling member, the first key configured to mate with the receiver slot of the frame, the second key configured to mate with another receiver slot of another frame secured to the wall, the another frame receiving another picture, the coupling member spacing the picture from the another picture.

In one embodiment the device includes a first level integrated into at least one of the first strut, the second strut, the third strut, and the fourth strut. In one embodiment the device includes a second level integrated into at least one of the first strut, the second strut, the third strut, and the fourth strut, the second level being orthogonal to the first level.

In one embodiment the device includes a central strut having a central aperture, wherein the central aperture receives a fastener to couple the frame to the wall in such a way that the frame can freely pivot about the fastener. In one embodiment the device includes one or more additional apertures that each receive another fastener for coupling the frame to the wall and prevent the frame from pivoting.

In one embodiment the receiver slot is associated with the first strut, the receiver slot comprising a partially rectangular peripheral shape that is orthogonal to an upper edge of the first strut. In one embodiment the partially rectangular peripheral shape comprises a first edge, a second edge, a third edge, and a fourth edge, the first edge and the fourth edge are angled to prevent the first key from disassociating with the receiver slot when the first key is coupled with the receiver slot.

According to some embodiments, the present disclosure is directed to a system comprising a first frame comprising a plurality of struts arranged into a polygon, wherein at least one of the plurality of struts comprises a receiver slot, the first frame being configured to be secured to a wall and receive a first picture; a second frame that is identical to the first frame, the second frame receiving a second picture; and a coupling member comprising a first key disposed on a first end of the coupling member and a second key disposed on a second end of the coupling member, the first key configured to mate with a first receiver slot of the first frame, the second key configured to mate with a second receiver slot of the second frame secured, the second frame receiving another picture, the coupling member spacing the first frame with the first picture from the second frame with the second picture.

In one embodiment the device includes a first level integrated into a first of the plurality of struts. In one embodiment the device includes a second level integrated into a second of the plurality of struts.

In one embodiment the first frame comprises a central strut having a central aperture, wherein the central aperture receives a fastener to couple the first frame to the wall in such a way that the first frame can freely pivot about the fastener.

In one embodiment the device includes one or more additional apertures that each receive another fastener for coupling the first frame to the wall and prevent the first frame from pivoting.

In one embodiment the first receiver slot comprises a partially rectangular peripheral shape. In one embodiment the device the partially rectangular peripheral shape comprises a first edge, a second edge, a third edge, and a fourth edge, the first edge and the fourth edge are angled to prevent the first key from disassociating with the first receiver slot when the first key is coupled with the first receiver slot.

In one embodiment the first frame has a first perimeter and the second frame has a second perimeter, the first perimeter being different than the second perimeter.

BRIEF DESCRIPTION OF THE DRAWINGS

The detailed description is set forth with reference to the accompanying drawings. The use of the same reference numerals may indicate similar or identical items. Various embodiments may utilize elements and/or components other than those illustrated in the drawings, and some elements and/or components may not be present in various embodiments. Elements and/or components in the figures are not necessarily drawn to scale. Throughout this disclosure, depending on the context, singular and plural terminology may be used interchangeably.

DETAILED DESCRIPTION

Overview

Figure 1:
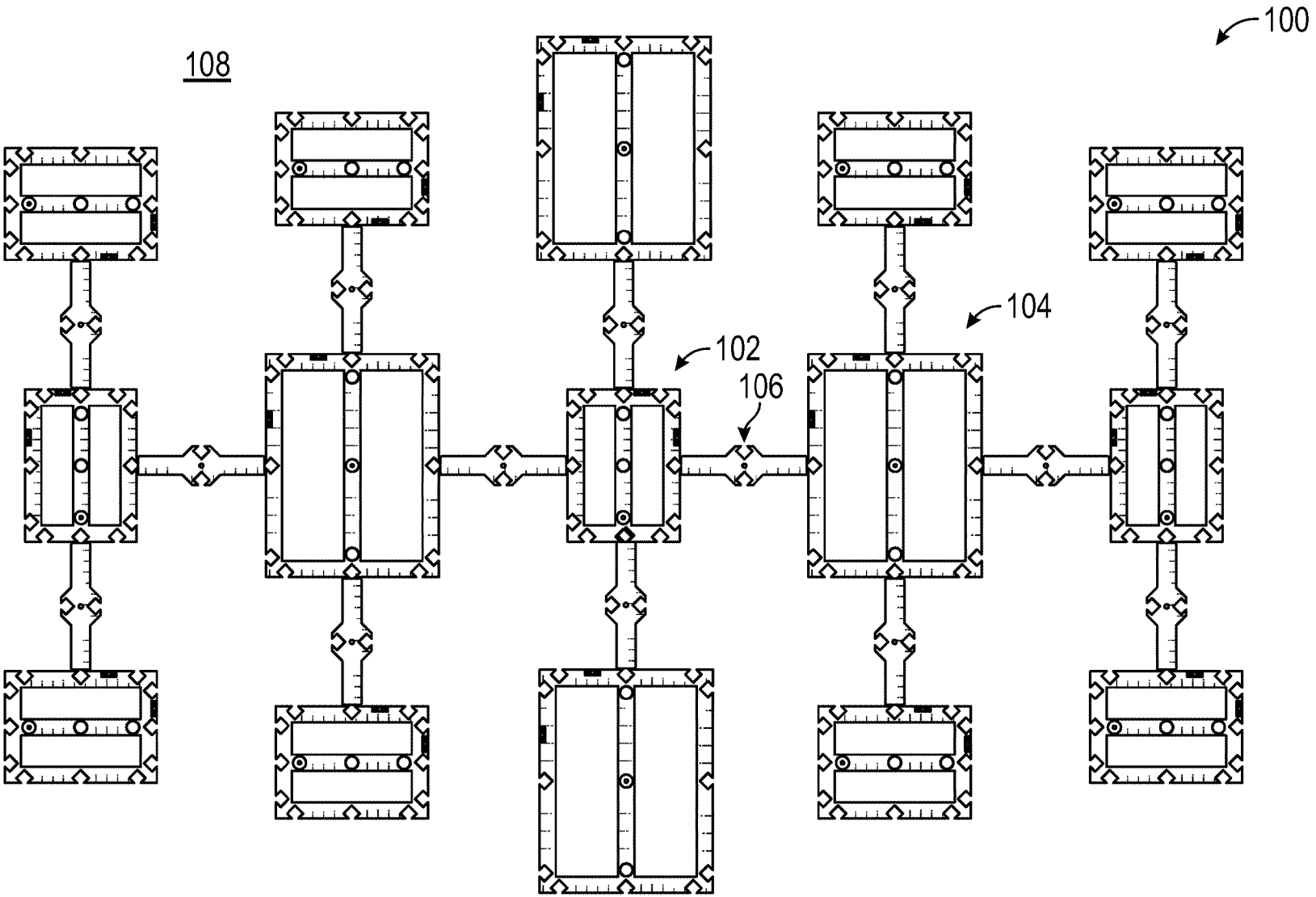
FIG. 1 is a perspective view of an example system of the present disclosure.

Installing a picture frame on a wall is a tedious process. Picture frames have various means for being mounted to a wall. Pictures frames can have a wide range of mechanisms for hanging. For example, some picture frames include notches or holes that receive anchors (such as fasteners) that are installed into the wall. Other picture frames can hang from a guide wire. In yet other examples, some picture frames include sawtooth brackets. Each different means may require a different methodology for ensuring that the picture is installed in a level configuration. The installer may have to transfer the locations of picture frame brackets onto the wall in order to install anchors. Thus, the user must not only ensure that they have properly measured and transferred these measurements to the wall, but also ensure that these anchor points on the wall are level relative to one another. Thus, there are tremendous obstacles that make hanging pictures difficult and frustrating for most users.

Additionally, these issues are further compounded when a user attempts to arrange a collage of two or more pictures in relation to one another. For example, if a user desires to hang two pictures in horizontal or vertical alignment, the user now must not only hang each of the pictures in a level manner, but also ensure that there is proper aesthetic and proportional spacing between the pictures.

The devices and systems disclosed herein reduce the complexity, difficulty, and frustration level of the user when hanging multiple pictures. Some embodiments utilize two or more frames that are constructed from struts. The struts have connection points, referred to as receiver slots located at various positions around the frame. Two frames can be temporarily connected to one another during placement to ensure proper spacing.

In general, a first frame can be installed on a wall using a centrally disposed aperture of one of the struts of the frame. A fastener can be placed through the central aperture to join the frame to the wall. The frame can pivot freely about this connection. A level incorporated into the frame can be used to ensure that the frame is level. Once a level position is achieved additional fasteners can be inserted into the frame to lock it into place.

To position another frame relative to this first frame, a connector member is coupled with a receiver slot of the first frame. A second picture frame can be connected to an opposing end of the connector member. The second frame can be secured to the wall with fasteners. As discussed herein, the connector member has uniquely shaped keys on its ends. The keys mate with the receiver slots. In some examples, the receiver slots and keys have a polygonal shape that prevent the keys from disassociating from the receiver slots until the user manually removes the connector member by pulling it away from the frames. These and other advantages are disclosed in greater detail herein relative to the collective drawings.

Illustrative Embodiments

FIG. 1 is a perspective view of an example system for hanging pictures. The system 100 includes a first frame 102, a second frame 104, and a coupling member 106. The first and second frames can be also referred to as a mounting frame because the frames 102 and 104 mount a picture frame to a wall.

Thus, in some embodiments, the first frame 102 can be initially secured to a wall 108. The coupling member 106 may be attached to the first frame 102 at one of a plurality of receiver slots of the first frame 102, as will be discussed in greater detail herein. The coupling member 106 extends away from the first frame 102. The second frame 104 is then coupled to the other end of the coupling member 106. When the second frame 104 is secured to the wall 108, the coupling member 106 can be removed.

Referring now to FIGS. 2A-2D collectively, the first frame 102 comprises a plurality of struts, such as a first strut 108A, a second strut 108B, a third strut 108C, and a fourth strut 108D. In some embodiments, the struts are arranged into a polygonal configuration such as a rectangle. The size and shape of the first frame 102 may vary. For example, a larger size can be used for larger pictures, while a relatively smaller frame can be used for smaller pictures. While the first frame 102 is generally rectangular in shape, it can also be a square, a triangle, or any other polygonal shape.

The first strut 108A can form a top of the first frame 102, with the second strut 108B forming a right side of the first frame 102. The third strut 108C forms a bottom of the first frame 102, and the fourth strut 108D forms a left side of the first frame 102. Each of the struts can include receiver slots. For example, the second strut 108B can include several receiver slots 110A, 110B, and 110C. The first, third, and fourth struts can also have one or more receiver slots.

Figure 2A:
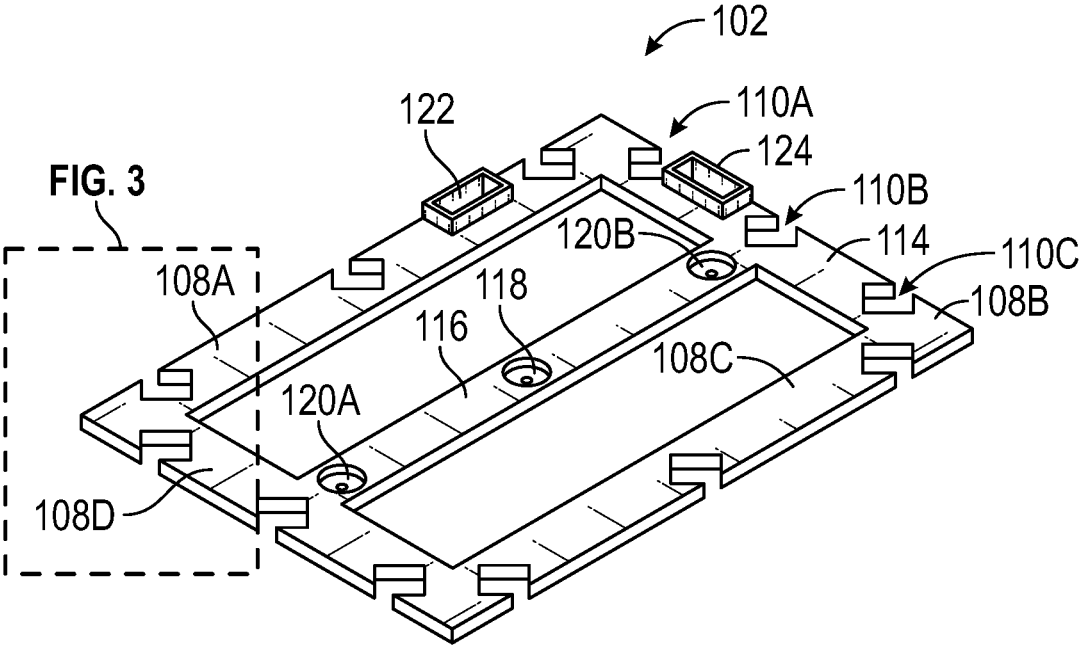
FIGS. 2A-2D collectively illustrate an example mounting frame of the system of FIG. 1.
Figure 2B:
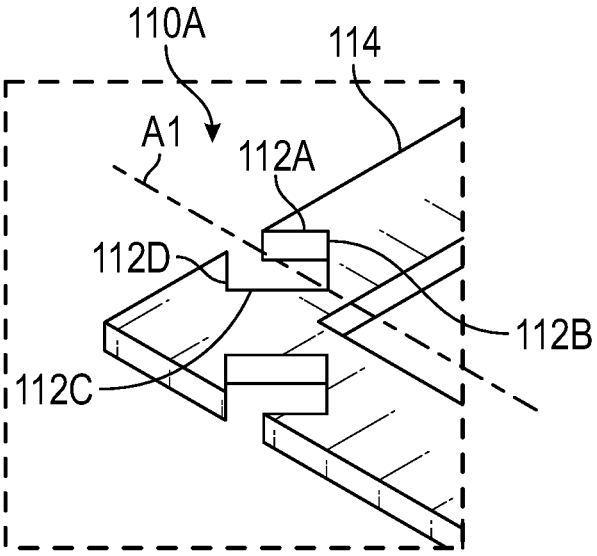
Figure 2C:
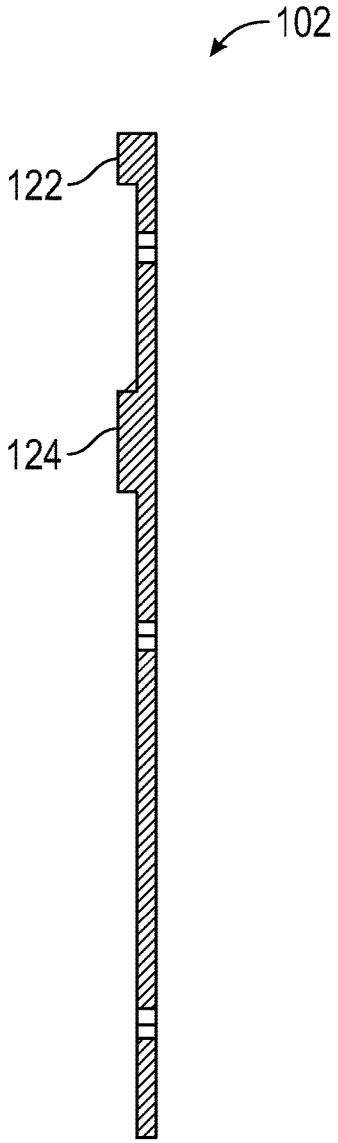
Figure 2D:
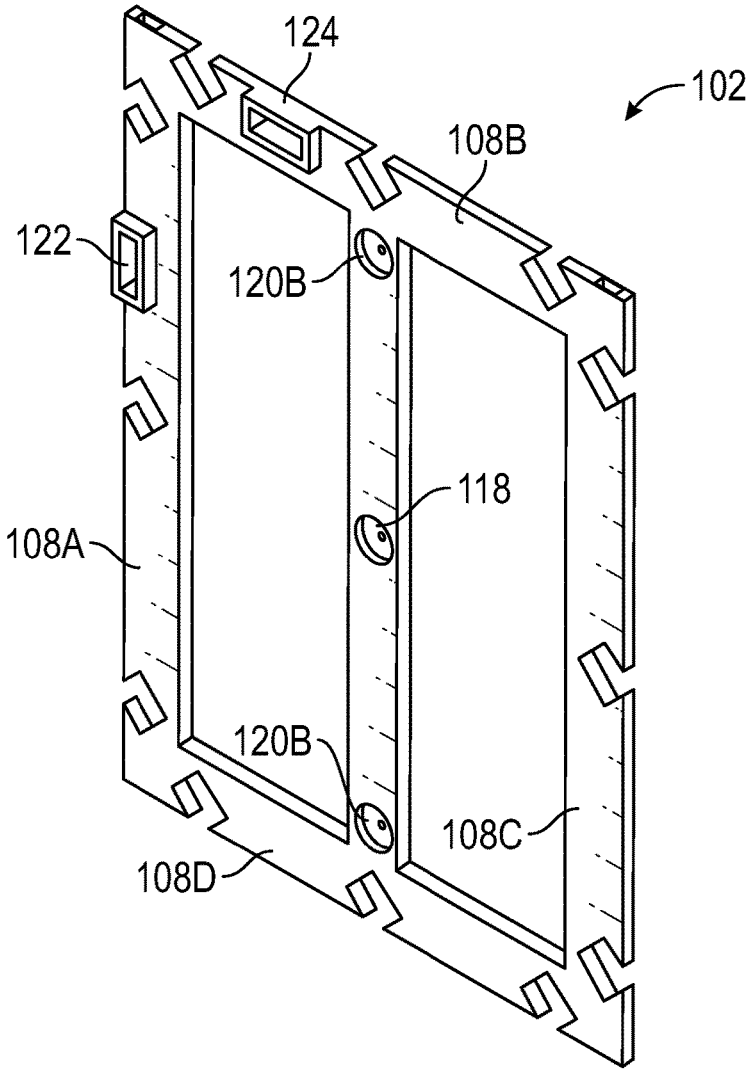

FIG. 2B is a close-up view of the receiver slot 110B. The receiver slot 110B is polygonal shaped, and in some instances is a partial diamond shape. Stated otherwise, the receiver slot 110A has a partially rectangular (e.g., diamond) peripheral shape that includes a first edge 112A, a second edge 112B, a third edge 112C, and a fourth edge 112D. In some embodiments, the receiver slot 110A is a square that has been rotated so that a central axis A1 is orthogonal to an edge 114 of the second strut 108B.

The first and fourth edges 112A and 112D are each angled as they extend inwardly from the edge 114. The second and third edges 112B and 112C each angle inwardly towards one another intersecting together at their terminal ends. As will be discussed infra, the receiver slot 110A can receive a key from a coupling member.

In some embodiments, the first frame 102 includes a central strut 116 that spans between the second strut 108B and the fourth strut 108D. In other embodiments, the central strut 116 can alternatively span between the first strut 108A and the third strut 108C. In addition to providing structural rigidity to the first frame 102, the central strut 116 includes a central aperture 118 that is placed at a central point of the first frame 102. The central aperture 118 can receive a fastener (see FIG. 6 as an example) for securing the first frame 102 to a wall. The central strut 116 can also include additional apertures, such as a second aperture 120A and a third aperture 120B that also receive fasteners to secure the first frame 102 to the wall. Example methods for using the first frame 102 are included below.

According to some embodiments, the first frame 102 can include a first level 122 that is associated with the first strut 108A. The first level 122 can be used to ensure that the first frame 102 is level. A second level 124 can be incorporated into the second strut 108B to ensure that the first frame 102 can be placed level regardless of the initial orientation of the first frame 102. For example, the first frame 102 can be placed level when the struts are oriented horizontally or alternatively in a vertical orientation (orthogonal to horizontal). In some instances, the levels are an attachment and not co-molded with the struts. A level can be attached to the body of the first frame 102 at any location. Thus, when used in combination, the first level 122 and the second level 124 can be used to ensure both level and square for the first frame 102. To be sure, the first level can be located on any horizontal strut, while the second level can be located on any vertical strut, or vice versa. In some embodiments, the second strut can be omitted.

Figure 3:
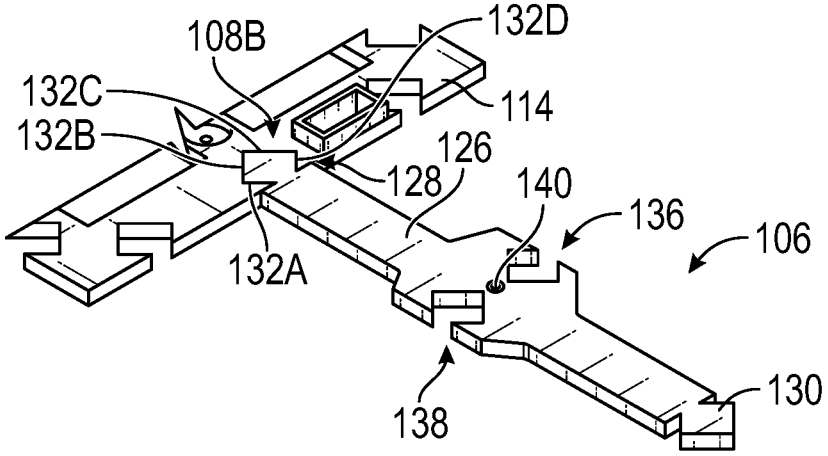
FIG. 3 is an isometric view of an example coupling member in combination with a portion of a mounting frame.
Figure 4A:
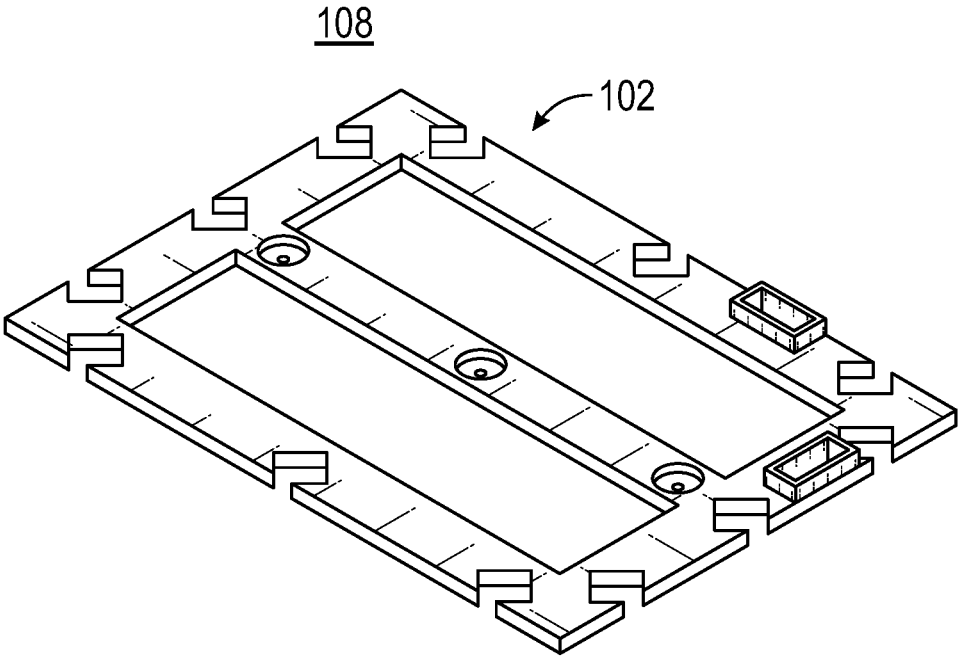
FIGS. 4A-4C collectively illustrate an installation of example frames on a wall.
Figure 4B:
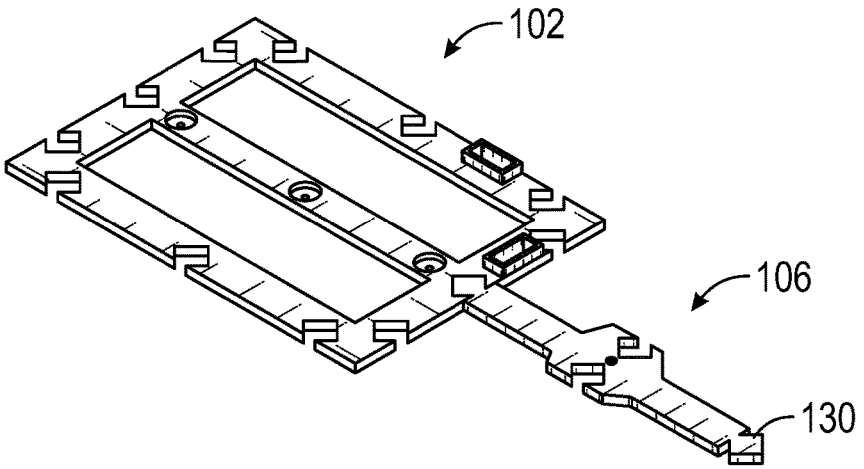
Figure 4C:
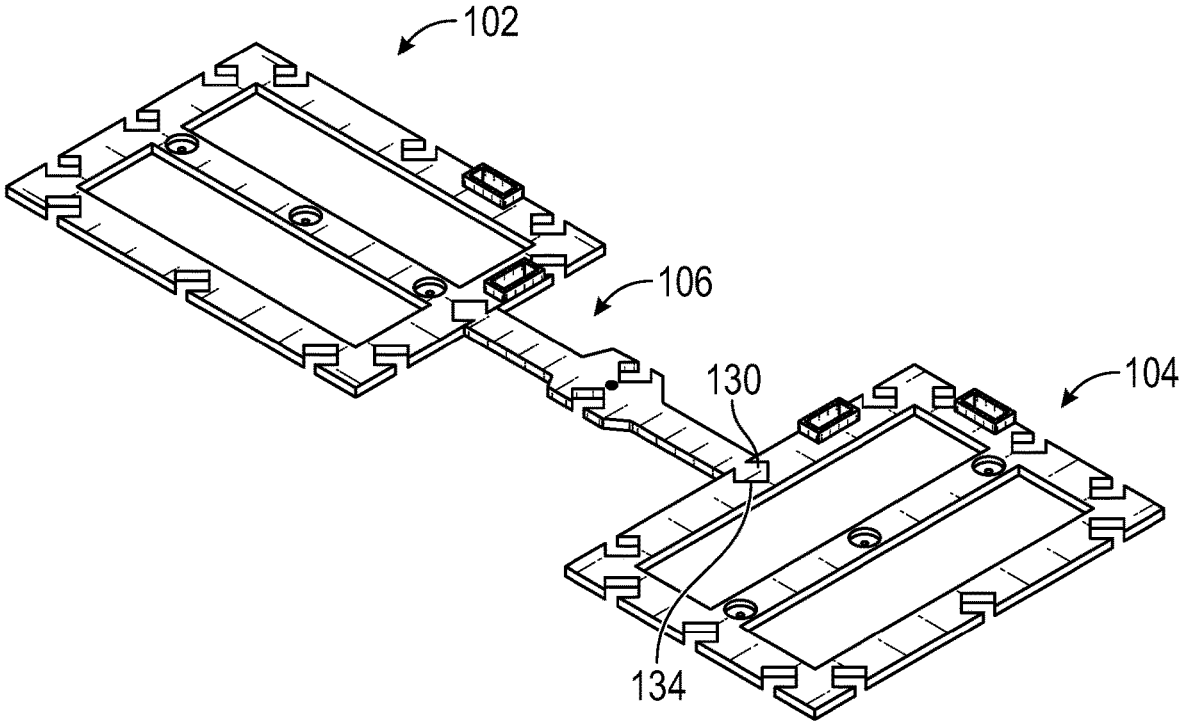

FIG. 3 illustrates the example coupling member of FIG. 1 in more detail. The coupling member 106 includes a body 126, a first key 128 and a second key 130. In general, the coupling member 106 is joined to the first frame 102. The coupling member 106 has a length that defines a distance that the second frame 104 will be placed at once the second frame 104 is connected to the coupling member 106.

The first key 128 has an arrow or diamond shape that corresponds to the shape of the receiver slot 110B. That is, the first key 128 fits into the receiver slot 110B like a puzzle piece. The second key 130 can be configured to fit into a receiver slot of the second frame 104, as will be illustrated with respect to FIGS. 5A-5C. In some embodiments, the first key 128 has an arrow or diamond shape that corresponds to the shape of the receiver slot 110B but other polygonal shapes can also be used.

In some embodiments, the first key 128 comprises a first edge 132A, a second edge 132B, a third edge 132C, and a fourth edge 132D. When the first key 128 is placed into the receiver slot 110A, the first edge 132A and the fourth edge 132D are captured by the first and fourth edges 112A and 112D of the receiver slot 110A to prevent the first key 128 from disassociating from the receiver slot 110A if pulled on by a user or by a frame.

In some embodiments, the body 126 of the coupling member 106 can be made from two elements that can be lengthened or retracted to change the overall length of the body 126. Thus, the length of the body can be adjusted as desired.

In various embodiments, the body 126 can also include receiver slots, such as receiver slots 136 and 138, which can mate with another coupling member (not shown). This allows another frame to branch off from the coupling member. In some configurations, the body 126 also includes a body aperture 140 that receives a fastener to temporarily secure the coupling member to the wall. As with the mounting frame, the coupling member can include a level that can be integrated into the body. The level can be used in addition to the level(s) of the mounting frame, or in lieu of the level(s) which may be omitted from the mounting frame in some embodiments.

Referring now to FIGS. 1-4C collectively, in an example installation process, a user locates the first frame 102 on to the wall 108. The user inserts a fastener into the central aperture 118 of the first frame 102. This positions and secures the first frame 102 to the wall 108, however, the first frame 102 can pivotally rotate free around the fastener, which allows the user to set a level for the first frame 102. The user can set the level for the first frame 102 using the first level 122. Once a level configuration has been achieved for the first frame 102, a user can insert additional fasteners into the first frame 102 at other apertures located along any of the struts of the first frame 102. This second securement locks the first frame in place such that it can no longer pivot about the first fastener in the central aperture 118.

Once the first frame 102 is secured to the wall, the user can place the first key 128 of the coupling member 106 into the receiver slot 110A of the first frame 102. The user can then connect the second frame 104 to the second key 130 of the coupling member 106. That is, the second key 130 is coupled with a receiver slot 134 of the second frame 104. The user can then secure the second frame 104 to the wall 108 with fasteners. The user can utilize level(s) on the second frame 104 to ensure level and square placement of the second frame. When the second frame 104 is secure, the coupling member 106 can be removed by the user lifting away the coupling member 106 from the first frame 102 and the second frame 104. Additional frames can be coupled to the first and/or second frames in a similar manner to create a collage of frames. Once the user has set their preferred number of frames, the user can then couple pictures to the frames as described herein.

In various embodiments, a picture frame can releasably connect to a frame of the present disclosure using magnets. For example, one or more of the struts of the frame can comprise a magnet or ferrous metal. The magnet or metal can be co-molded into the frame or attached with any other means. A corresponding magnet (see FIG. 5) is coupled to a back of the picture frame. The magnets to the corresponding components releasably secure the picture with the frame. To be sure, other methods for securing (either permanently or temporarily) the picture to the frame can be used.

Figure 5:
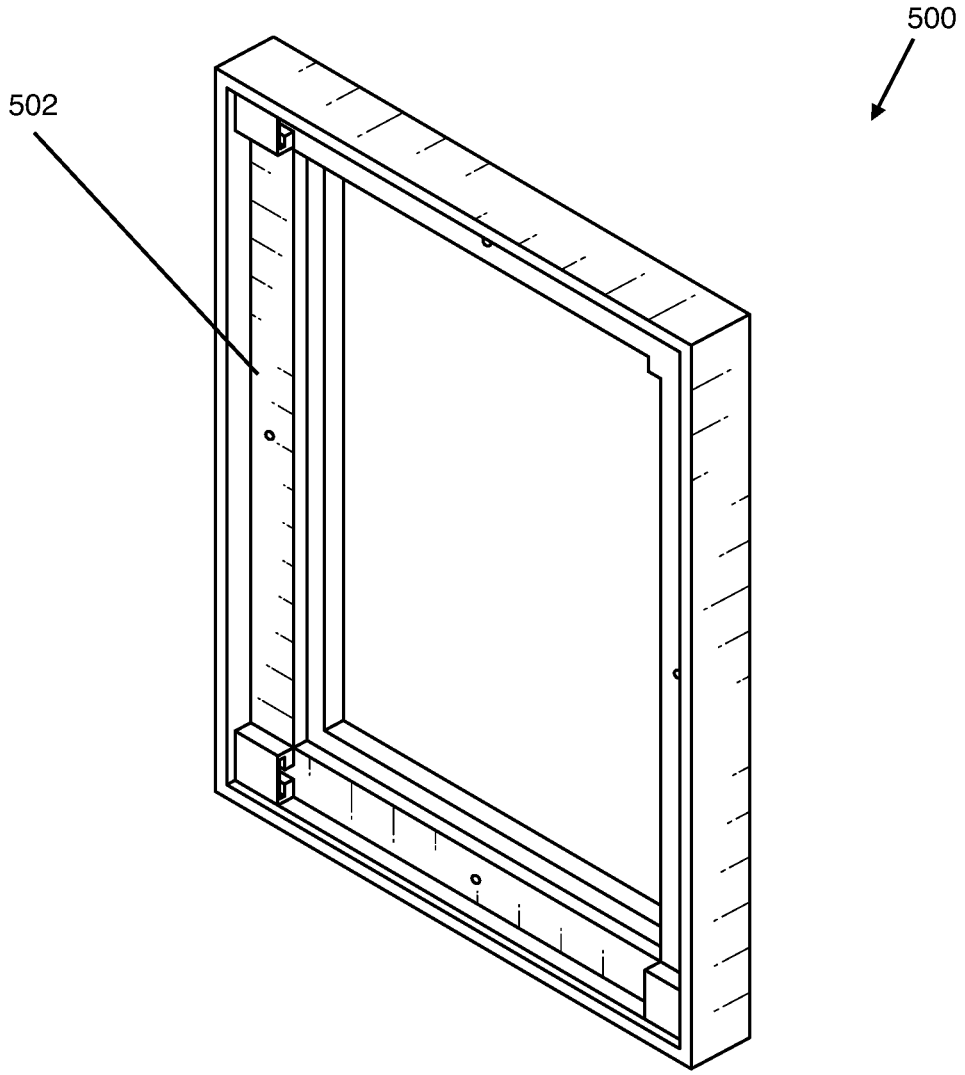
FIG. 5 illustrates an example picture frame that can be used in the system of FIG. 1.
Figure 6:
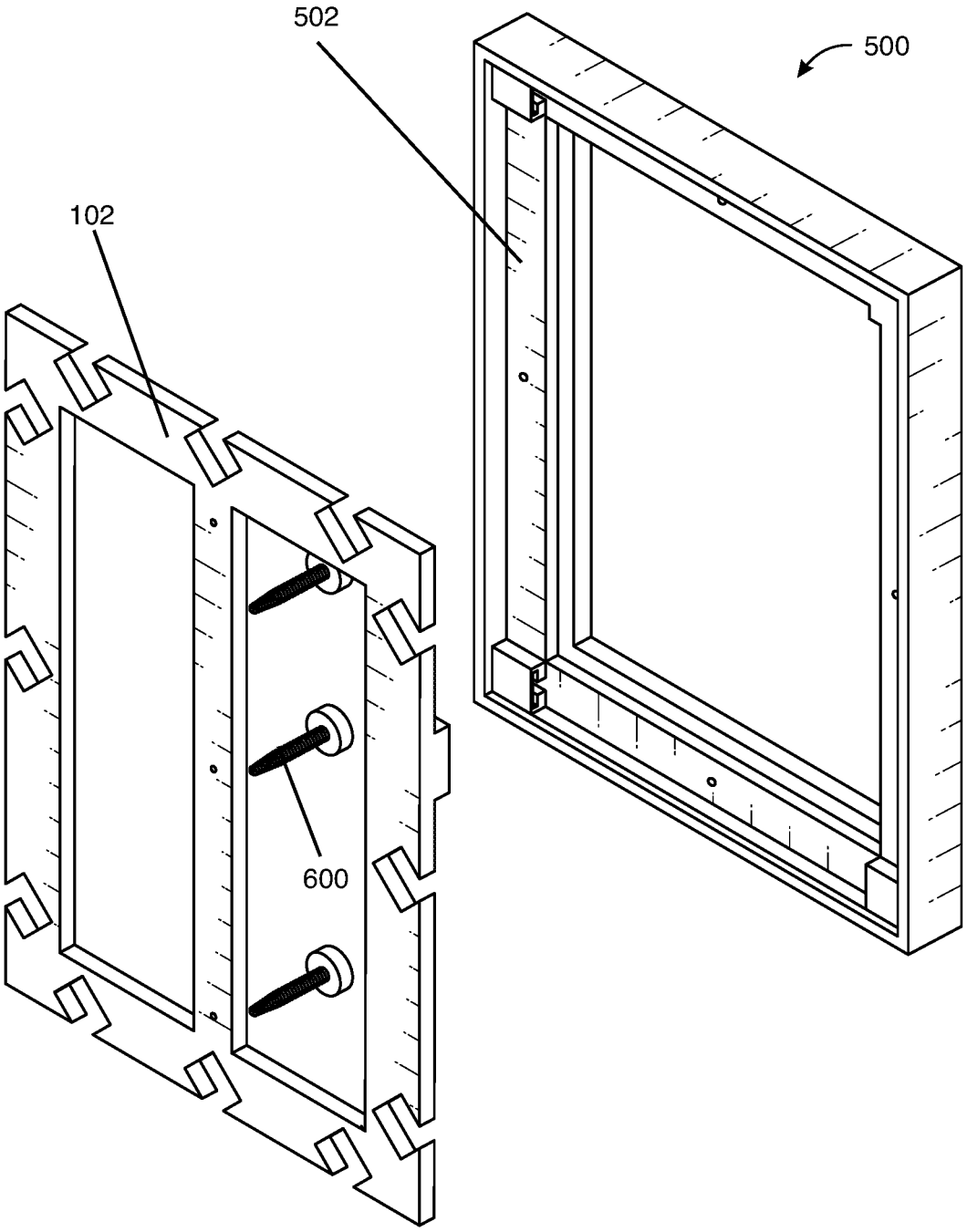
FIG. 6 is an exploded perspective view of an example frame and picture frame of the present disclosure.

FIG. 5 illustrates a portion of an example picture frame 500 that can be used to couple a picture to a frame of the present disclosure such as first frame 102 (see FIG. 6). The picture frame 500 includes a frame body 502 that can be sized as desired. The shape and outline of the frame body 502 can have any aesthetic or ornamental design. The frame body 502 can include a picture recess. The frame body 502 is also sized to receive the first frame 102 (as illustrated in FIG. 6). The recess 504 is provides room to receive the mounting frame and some additional height of the levels (if present on the mounting frame). A secondary recess is located below 504 (closer to the display side of the frame) that will receive a picture, glass, and backing board. The apertures in the center of the struts on 504 are fastener holes to allow swivel mounts to hold the picture, glass and backing board to the frame as mentioned above.

In some embodiments, a backer plate can be secured against the backside of the picture and secured with hinge tabs, locking members, or other releaseable fastening members. In various embodiments, the frame body 502 can include magnets, such as magnet 506 that are positioned in the corners of the frame body 502. These magnets cooperate with magnetic elements in the first frame 102, as best illustrated in FIG. 6. To be sure, the respective placement of magnetic elements and/or ferrous material can vary as desired. For example, in one embodiment the picture frame includes a magnet and the mounting frame FIG. 6 illustrates the picture frame 500 in combination with the first frame 102 and a plurality of fasteners, such as push pins. When the first frame 102 is attached to a wall and leveled, the push pins are inserted to secure the first frame 102 to the wall. Next, the picture frame 500 is placed over the first frame 102 such that the first frame 102 nests inside the frame body 502. As noted above, magnets present in the corners of the frame body 502 and mate with magnetic elements in the corners of the first frame 102 to secure the first frame 102 to the picture frame 500. To be sure, while magnets have been disclosed, other securement elements can also be used, such as a push pin 600. Also, in some embodiments, the frame body 502 can be configured to snap around the first frame 102 similar to a compression or friction fit.

Figure 7:
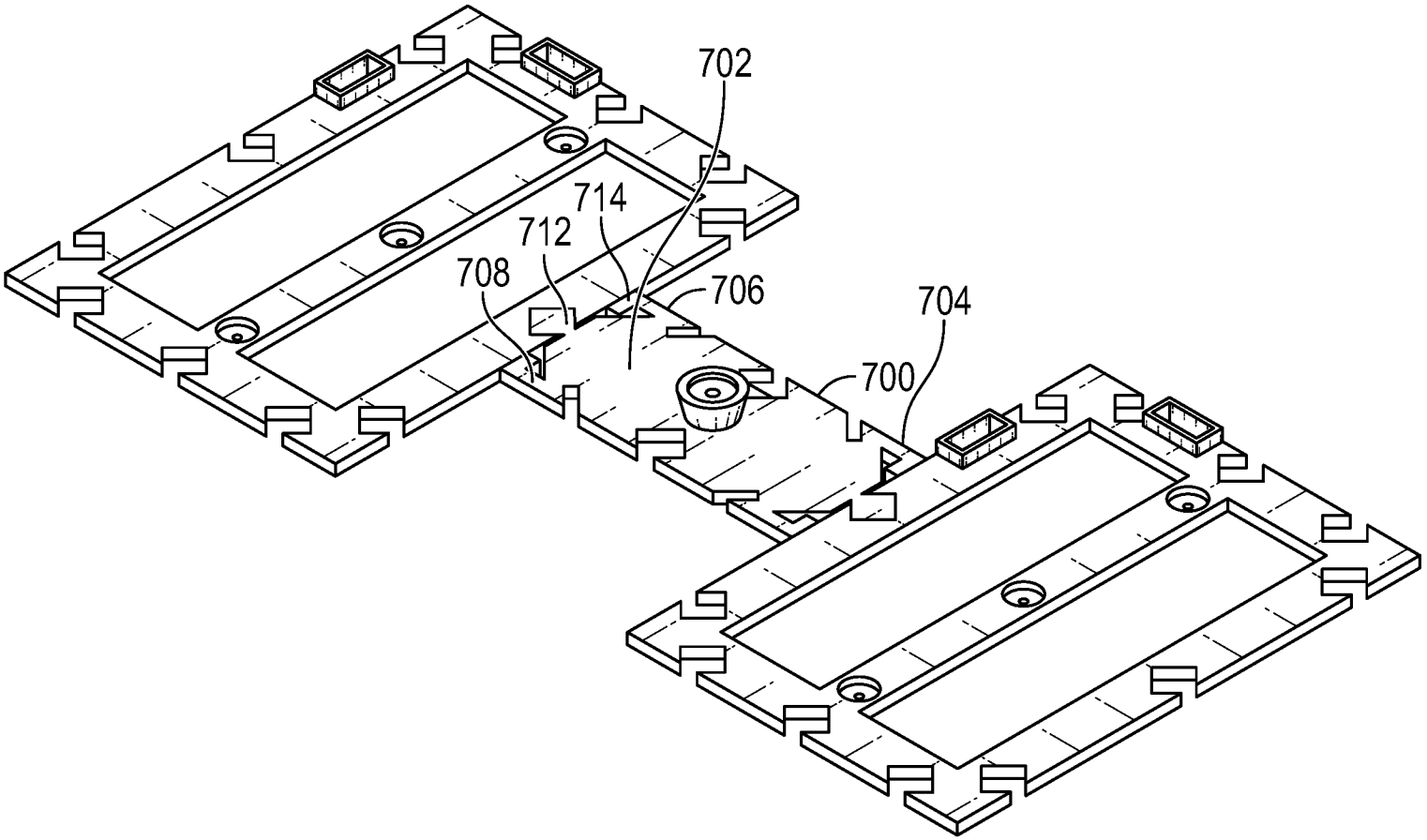
FIGS. 7 and 8 collectively illustrate another example coupling member.
Figure 8:
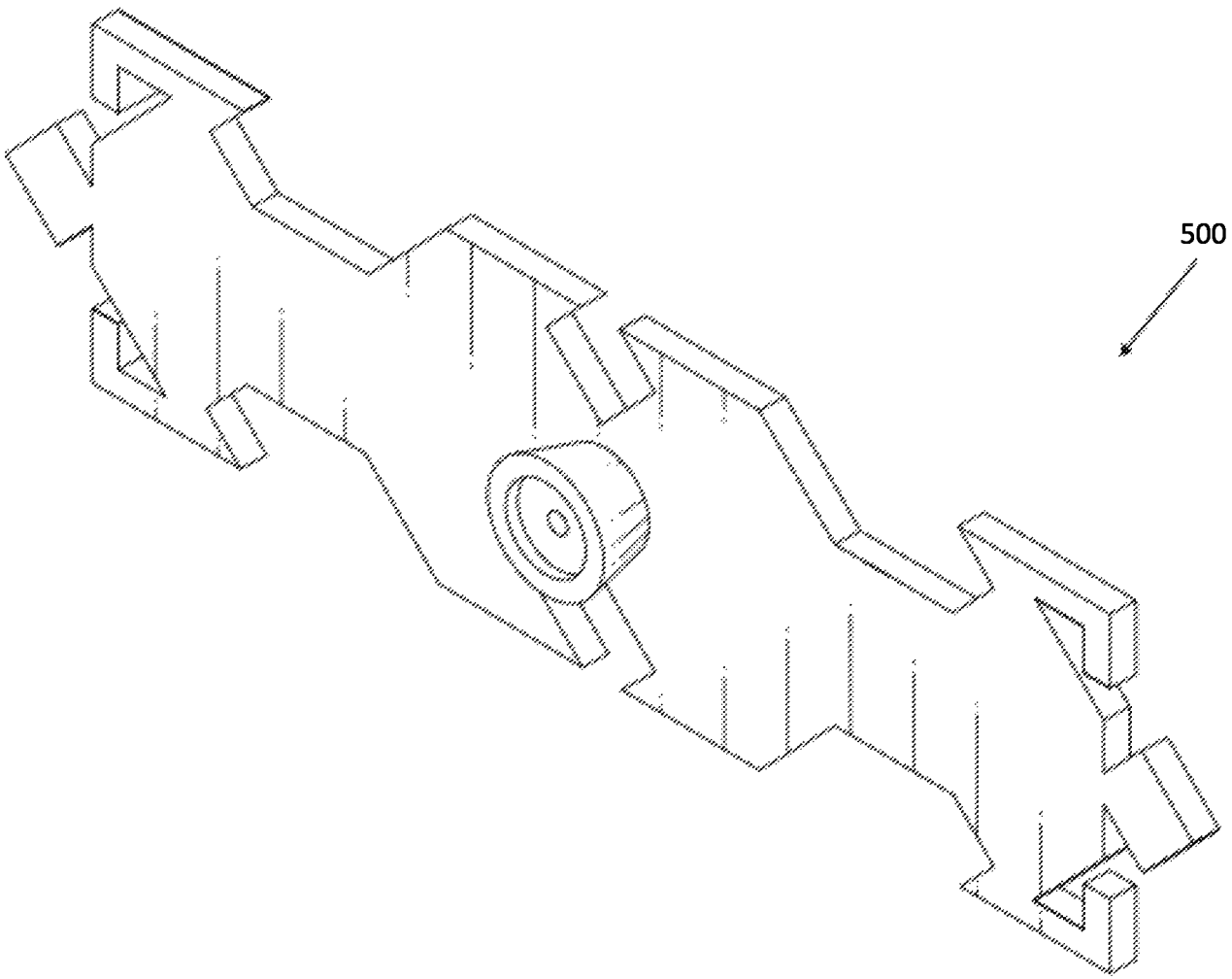
Figure 9:
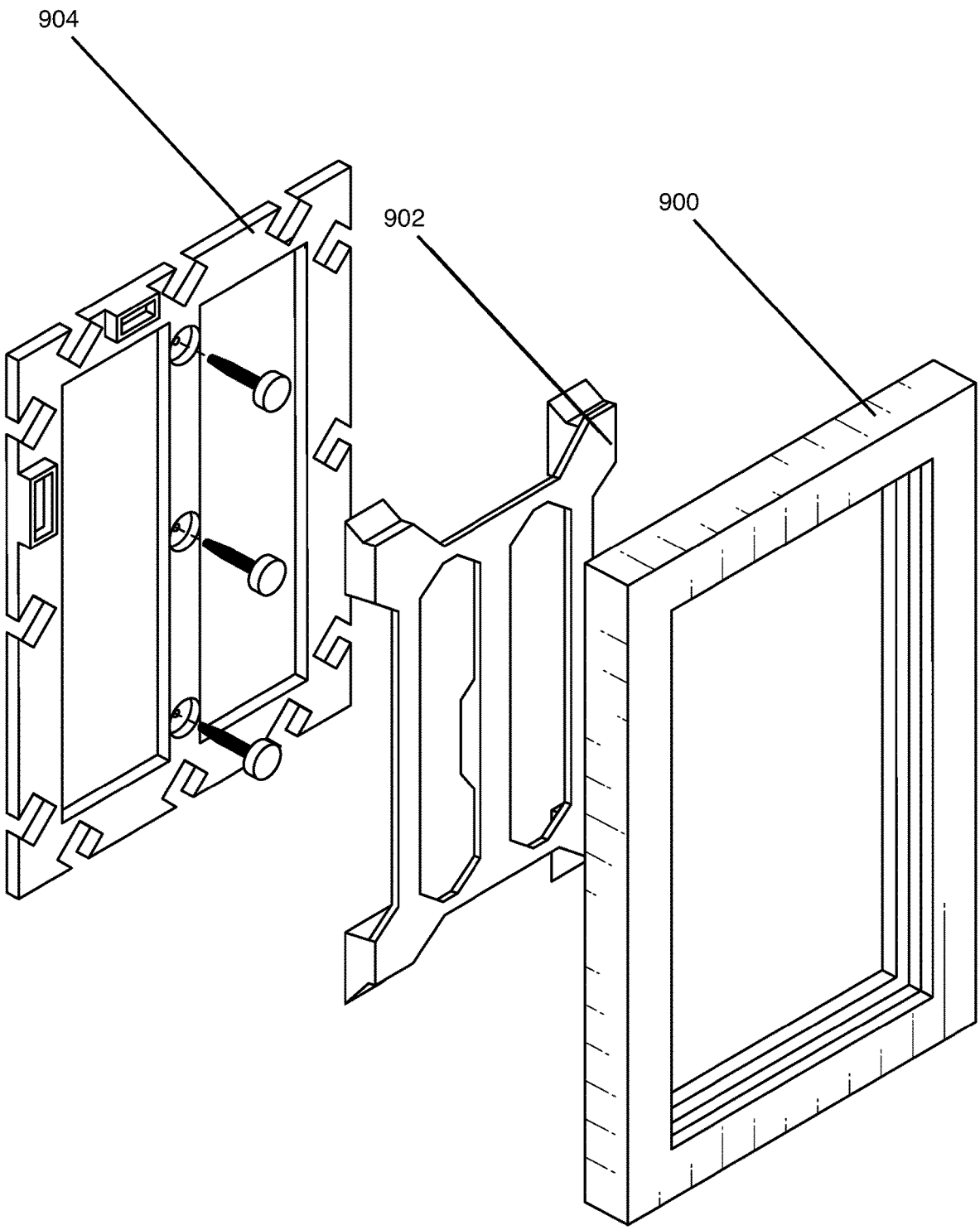
FIG. 9 illustrates another example assembly for hanging a picture frame.
Figure 10:
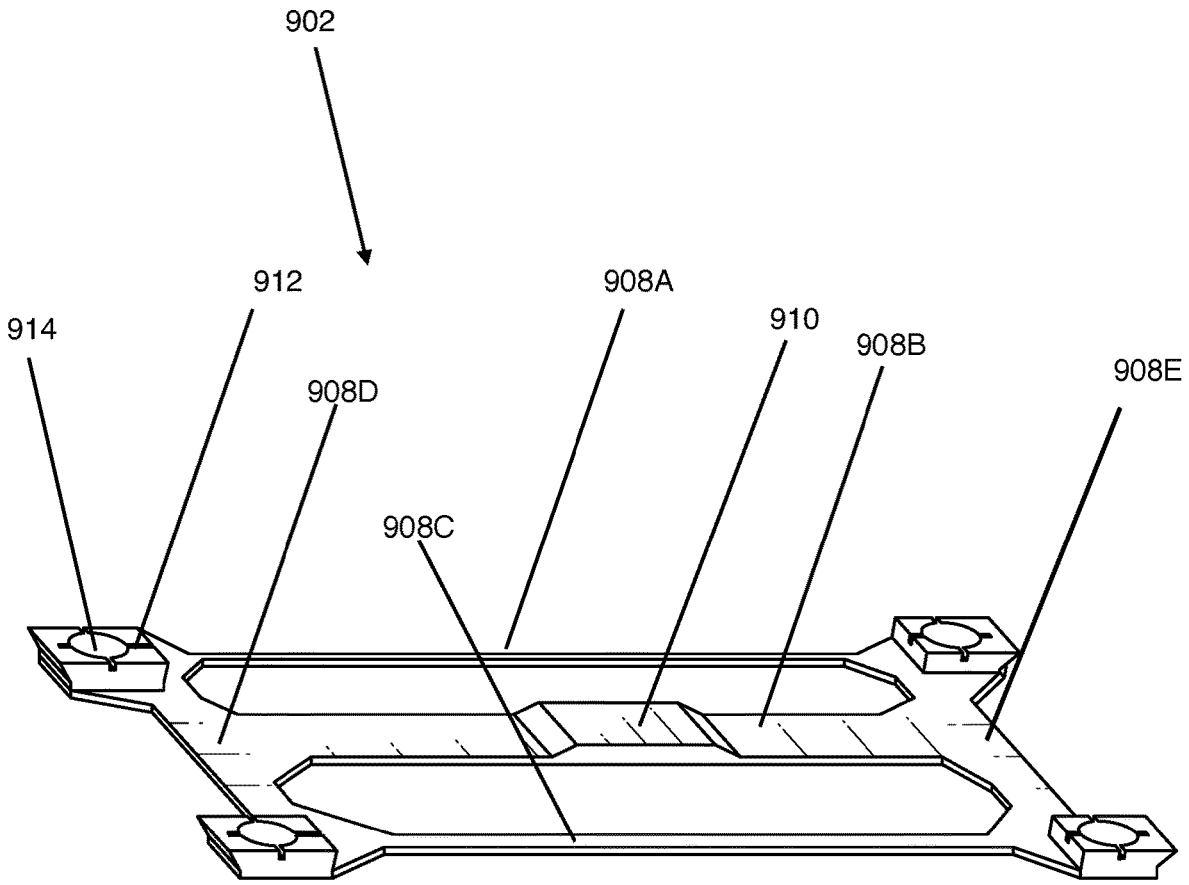
FIG. 10 illustrates an intermediate member of the example assembly of FIG. 9.
Figure 11:
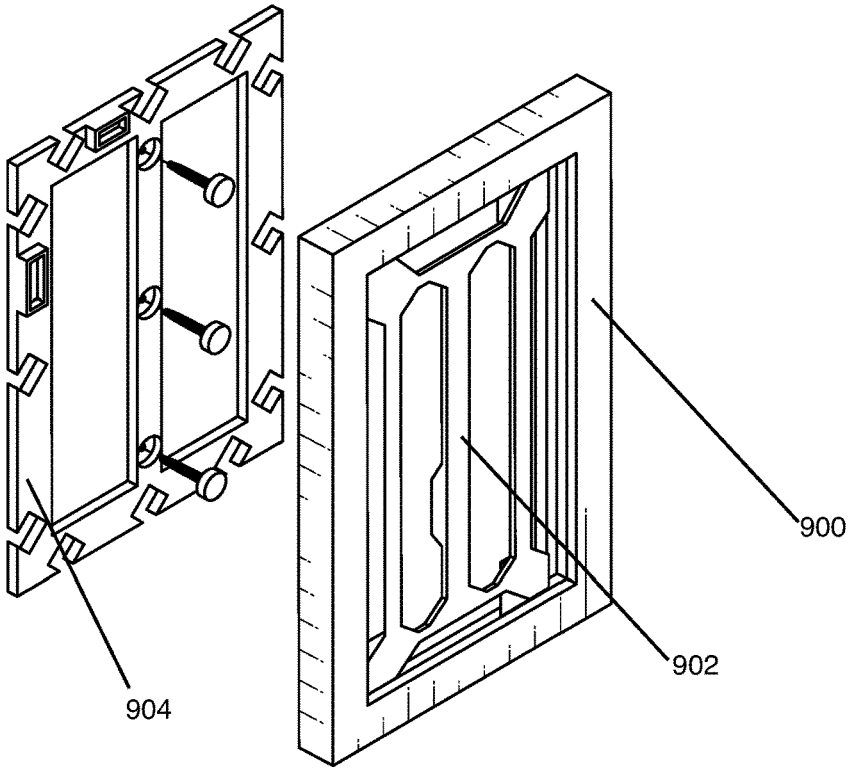
FIG. 11 is an exploded perspective view of an example frame and a combination of the intermediate member of FIG. 10 and an example picture frame.
Figure 12:
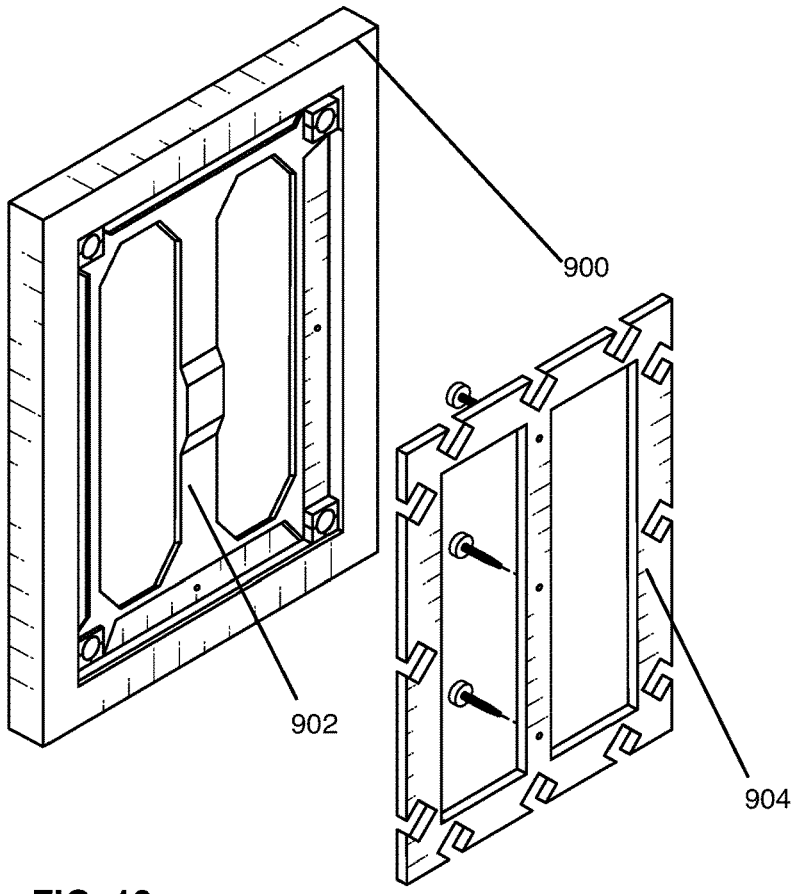
FIG. 12 is a reverse, exploded perspective view of an example frame and a combination of the intermediate member of FIG. 10 and an example picture frame.

FIGS. 7 and 8 collective illustrates another example coupling member 700 that is used to couple and space two or more frames. This coupling member 700 includes two opposing terminal ends 702 and 704. Each of the terminal ends includes armatures. For example, the terminal end 702 includes a first armature 706 and a second armature 708, with a key 710 spaced therebetween. The armatures are configured to provide an alignment and support to prevent a frame, such as frame 712 from rotating or pivoting about the key 710. The armatures also ensure that the mounting frames 102 and 104 are parallel to each other when installed on the wall.

In one embodiment, the first armature 706 includes a support link 714 that engages with an edge of the frame 712 when the coupling member 700 is joined to the frame 712. In some embodiments, the coupling member 700 includes a protrusion or knob that can be grabbed by the user to position the coupling member 700 on the wall. As noted above, a central aperture is present to receive a fastener as mentioned above. The example coupling member 700 can also include a protrusion 716 or knob that can be employed by the user grasp and manipulate the example coupling member 700.

FIGS. 9-12 collectively illustrate another example embodiment. In this embodiment, a picture frame 900, an intermediate support 902, and a mounting frame 904 are present. It will be understood that the picture frame 900 and the mounting frame 904 are similar, if not identical to the picture frame and mounting frames described above. The intermediate support 902 provides additional structural support and rigidity, as well as enhances ease of alignment between the picture frame 900 and the mounting frame 904. The intermediate support 902 includes a frame 906 made from three struts 908A-908C connected at the ends with end struts 908D and 908E. The middle of the strut 908B is provided with a gripping member 910 that can be utilized by a user to engage and/or disengage the intermediate support 902 with the picture frame 900. In some embodiments, the gripping member 910 also provides support and contacts the middle/central strut of the of the mounting frame 904. According to some embodiments, the intermediate support 902 can snap into or otherwise securely engage with a recess created in the picture frame 900

In some embodiments, each corner of the intermediate support 902 includes a magnet base. For example, a first corner of the intermediate support 902 includes a magnet base 912 that receives a magnet 914. The magnets of the magnet bases at each of the corners of the intermediate support 902 can engage with the magnets or ferrous material of the struts of the mounting frame 904, as discussed above.

Any and/or all elements, as disclosed herein, can be formed from a same, structurally continuous piece, such as being unitary, and/or be separately manufactured and/or connected, such as being an assembly and/or modules. Any and/or all elements, as disclosed herein, can be manufactured via any manufacturing processes, whether additive manufacturing, subtractive manufacturing and/or other any other types of manufacturing. For example, some manufacturing processes include three-dimensional (3D) printing, laser cutting, computer numerical control (CNC) routing, milling, pressing, stamping, vacuum forming, hydroforming, injection molding, lithography and/or others.

Any and/or all elements, as disclosed herein, can include, whether partially and/or fully, a solid, including a metal, a mineral, a ceramic, an amorphous solid, such as glass, a glass ceramic, an organic solid, such as wood and/or a polymer, such as rubber, a composite material, a semiconductor, a nano-material, a biomaterial and/or any combinations thereof. Any and/or all elements, as disclosed herein, can include, whether partially and/or fully, a coating, including an informational coating, such as ink, an adhesive coating, a melt-adhesive coating, such as vacuum seal and/or heat seal, a release coating, such as tape liner, a low surface energy coating, an optical coating, such as for tint, color, hue, saturation, tone, shade, transparency, translucency, non-transparency, luminescence, anti-reflection and/or holographic, a photo-sensitive coating, an electronic and/or thermal property coating, such as for passivity, insulation, resistance or conduction, a magnetic coating, a water-resistant and/or waterproof coating, a scent coating and/or any combinations thereof.

The corresponding structures, materials, acts, and equivalents of all means or step plus function elements in the claims below are intended to include any structure, material, or act for performing the function in combination with other claimed elements as specifically claimed. The description of the present technology has been presented for purposes of illustration and description, but is not intended to be exhaustive or limited to the present technology in the form disclosed. Many modifications and variations will be apparent to those of ordinary skill in the art without departing from the scope and spirit of the present technology. Exemplary embodiments were chosen and described in order to best explain the principles of the present technology and its practical application, and to enable others of ordinary skill in the art to understand the present technology for various embodiments with various modifications as are suited to the particular use contemplated.

If any disclosures are incorporated herein by reference and such incorporated disclosures conflict in part and/or in whole with the present disclosure, then to the extent of conflict, and/or broader disclosure, and/or broader definition of terms, the present disclosure controls. If such incorporated disclosures conflict in part and/or in whole with one another, then to the extent of conflict, the later-dated disclosure controls.

The terminology used herein can imply direct or indirect, full or partial, temporary or permanent, immediate or delayed, synchronous or asynchronous, action or inaction. For example, when an element is referred to as being "on," "connected" or "coupled" to another element, then the element can be directly on, connected or coupled to the other element and/or intervening elements may be present, including indirect and/or direct variants. In contrast, when an element is referred to as being "directly connected" or "directly coupled" to another element, there are no intervening elements present.

Although the terms first, second, etc. may be used herein to describe various elements, components, regions, layers and/or sections, these elements, components, regions, layers and/or sections should not necessarily be limited by such terms. These terms are only used to distinguish one element, component, region, layer or section from another element, component, region, layer or section. Thus, a first element, component, region, layer or section discussed below could be termed a second element, component, region, layer or section without departing from the teachings of the present disclosure.

The terminology used herein is for the purpose of describing particular embodiments only and is not intended to be necessarily limiting of the disclosure. As used herein, the singular forms "a," "an" and "the" are intended to include the plural forms as well, unless the context clearly indicates otherwise. The terms "comprises," "includes" and/or "comprising," "including" when used in this specification, specify the presence of stated features, integers, steps, operations, elements, and/or components, but do not preclude the presence or addition of one or more other features, integers, steps, operations, elements, components, and/or groups thereof.

Example embodiments of the present disclosure are described herein with reference to illustrations of idealized embodiments (and intermediate structures) of the present disclosure. As such, variations from the shapes of the illustrations as a result, for example, of manufacturing techniques and/or tolerances, are to be expected. Thus, the example embodiments of the present disclosure should not be construed as necessarily limited to the particular shapes of regions illustrated herein, but are to include deviations in shapes that result, for example, from manufacturing.

In this description, for purposes of explanation and not limitation, specific details are set forth, such as particular embodiments, procedures, techniques, etc. in order to provide a thorough understanding of the present invention. However, it will be apparent to one skilled in the art that the present invention may be practiced in other embodiments that depart from these specific details.

Reference throughout this specification to "one embodiment" or "an embodiment" means that a particular feature, structure, or characteristic described in connection with the embodiment is included in at least one embodiment of the present invention. Thus, the appearances of the phrases "in one embodiment" or "in an embodiment" or "according to one embodiment" (or other phrases having similar import) at various places throughout this specification are not necessarily all referring to the same embodiment. Furthermore, the particular features, structures, or characteristics may be combined in any suitable manner in one or more embodiments. Furthermore, depending on the context of discussion herein, a singular term may include its plural forms and a plural term may include its singular form. Similarly, a hyphenated term (e.g., "on-demand") may be occasionally interchangeably used with its non-hyphenated version (e.g., "on demand"), a capitalized entry (e.g., "Software") may be interchangeably used with its non-capitalized version (e.g., "software"), a plural term may be indicated with or without an apostrophe (e.g., PE's or PEs), and an italicized term (e.g., "N+1?") may be interchangeably used with its non-italicized version (e.g., "N+1"). Such occasional interchangeable uses shall not be considered inconsistent with each other.

That which is claimed is:

1. A device comprising:

a frame comprising a first strut, a second strut, a third strut, and a fourth strut, wherein at least one of the first strut, the second strut, the third strut, and the fourth strut comprise a receiver slot, the frame being configured to be secured to a wall and receive a picture frame;

a coupling member comprising a first key disposed on a first end of the coupling member and a second key disposed on a second end of the coupling member, the first key configured to mate with the receiver slot of the frame, the second key configured to mate with another receiver slot of another frame secured to the wall, the another frame being configured to receive another picture frame, the coupling member spacing the picture from the another picture frame; and wherein the picture frame is installed over the frame to hide the receiver slot and frame, the frame nesting inside the picture frame, and the another picture frame is installed over the another frame and hides the another receiver slot and the another frame, the another frame nesting inside the another picture frame.

2. The device according to claim 1, further comprising a first level integrated into at least one of the first strut, the second strut, the third strut, and the fourth strut.

3. The device according to claim 2, further comprising a second level integrated into at least one of the first strut, the second strut, the third strut, and the fourth strut, the second level being orthogonal to the first level.

4. The device according to claim 1, further comprising a central strut having a central aperture, wherein the central aperture receives a fastener to couple the frame to the wall in such a way that the frame can freely pivot about the fastener.

5. The device according to claim 4, further comprising one or more additional apertures that each receive another fastener for coupling the frame to the wall and prevent the frame from pivoting.

6. The device according to claim 1, wherein the receiver slot is associated with the first strut, the receiver slot comprising a partially rectangular peripheral shape that is orthogonal to an upper edge of the first strut.

7. The device according to claim 6, wherein the partially rectangular peripheral shape comprises a first edge, a second edge, a third edge, and a fourth edge, the first edge and the fourth edge are angled to prevent the first key from disassociating with the receiver slot when the first key is coupled with the receiver slot.

8. A system comprising:

a first frame comprising a plurality of struts arranged into a polygon, wherein at least one of the plurality of struts comprises a receiver slot, the first frame being configured to be secured to a wall and receive a first picture frame, the first frame nesting inside the first picture frame;

a second frame that is identical to the first frame, the second frame receiving a second picture frame, the second frame nesting inside the second picture frame;

a coupling member comprising a first key disposed on a first end of the coupling member and a second key disposed on a second end of the coupling member, the first key configured to mate with a first receiver slot of the first frame, the second key configured to mate with a second receiver slot of the second frame secured, the coupling member spacing the first frame from the second frame; and wherein the coupling member is removed by a user after the frame and the second frame have been secured to the wall and before the first picture frame and the second picture frame are installed.

9. The system according to claim 8, further comprising a first level integrated into a first of the plurality of struts.

10. The system according to claim 9, further comprising a second level integrated into a second of the plurality of struts.

11. The system according to claim 10, wherein the first frame comprises a central strut having a central aperture, wherein the central aperture receives a fastener to couple the first frame to the wall in such a way that the first frame can freely pivot about the fastener.

12. The system according to claim 11, further comprising one or more additional apertures that each receive another fastener for coupling the first frame to the wall and prevent the first frame from pivoting.

13. The system according to claim 12, wherein the first receiver slot comprises a partially rectangular peripheral shape.

14. The system according to claim 13, wherein the partially rectangular peripheral shape comprises a first edge, a second edge, a third edge, and a fourth edge, the first edge and the fourth edge are angled to prevent the first key from disassociating with the first receiver slot when the first key is coupled with the first receiver slot.

15. A method of mounting picture frames comprising:

installing a first frame comprising a plurality of struts arranged into a polygon, wherein at least one of the plurality of struts comprises a receiver slot, the first frame being secured to a wall;

inserting a coupling member comprising a first key disposed on a first end of the coupling member and a second key disposed on a second end of the coupling member, the first key mating with a first receiver slot of the first frame;

mating the second key with a second receiver slot of a second frame, the second frame receiving another picture, the coupling member spacing the first frame from the second frame;

securing the second frame to the wall;

removing the coupling member;

installing a first picture frame onto the first frame such that the first frame nests inside the first frame; and installing a second picture frame onto the second frame such that the second frame nests inside the second frame.

* * * * *